United States Patent [19]

Yan

[11] Patent Number: 4,709,118

[45] Date of Patent: Nov. 24, 1987

[54] REMOVAL OF MERCURY FROM NATURAL GAS AND LIQUID HYDROCARBONS UTILIZING DOWNSTREAM GUARD CHABMER

[75] Inventor: Tsoung Y. Yan, Philadelphia, Pa.

[73] Assignee: Mobil Oil Corporation, New York, N.Y.

[21] Appl. No.: 911,184

[22] Filed: Sep. 24, 1986

[51] Int. Cl.[4] ..... C10G 29/02

[52] U.S. Cl. ..... 585/820; 208/253; 208/251 R; 208/292

[58] Field of Search ..... 208/253, 292, 251 R, 208/296, 299; 502/352, 342, 407, 417; 62/17, 18; 585/820; 55/72, 78; 423/242

[56] References Cited

U.S. PATENT DOCUMENTS

| | | | |
|---|---|---|---|
| 2,643,525 | 6/1953 | Cartier | 62/18 |
| 3,130,044 | 4/1964 | Flindt | 420/526 |
| 3,193,987 | 7/1965 | Manes et al. | 423/210 |
| 3,258,432 | 6/1966 | Gasson et al. | 502/352 |
| 3,403,177 | 9/1968 | Brown et al. | 502/352 X |
| 3,786,619 | 1/1974 | Melkersson et al. | 423/210 X |
| 3,888,124 | 6/1975 | Campbell et al. | 502/407 X |
| 4,044,098 | 8/1977 | Miller et al. | 423/210 |
| 4,101,631 | 7/1978 | Ambrosini et al. | 423/210 |
| 4,150,962 | 4/1979 | Colton | 208/351 X |
| 4,230,486 | 10/1980 | Capuano et al. | 423/99 X |
| 4,338,288 | 7/1982 | Rollmann | 423/210 |
| 4,462,896 | 7/1984 | Kitagawa et al. | 208/253 |
| 4,474,896 | 10/1984 | Chao | 502/216 |

*Primary Examiner*—Andrew Metz
*Assistant Examiner*—Glenn Caldarola
*Attorney, Agent, or Firm*—A. J. McKillop; M. G. Gilman; V. D. Harrison

[57] ABSTRACT

Hydrocarbon liquids an gas, particularly gas to be processed in LNG plants, are treated to remove mercury by contacting them with free bismuth or tin or a mixture of these on silica, alumina, or other type of non-reactive base. The sorbent is prepared by milling together the oxide of bismuth or tin and the silica or alumina base and subsequently reducing the oxide in a heated reducing atmosphere.

25 Claims, 2 Drawing Figures

(27) 7-22-86 #402 B: IS: $O_2$
5 KX ADF EE SEC-6-$C_1$

REMOVAL OF MERCURY FROM NATURAL GAS AND LIQUID HYDROCARBONS UTILIZING DOWNSTREAM GUARD CHABMER

NATURE OF THE INVENTION

This invention relates to a method for purifying and removing trace amounts of mercury and mercury compounds from raw natural gas. In another aspect this invention relates to an improved absorbent composition for absorbing trace amounts of the mercury present in the gas.

PRIOR ART

Raw natural gas must be treated prior to its liquefaction for several reasons. These include removing compounds which interfere with the liquefaction process, with the separation and recovery of hydrocarbon liquids and with meeting the specifications set for the recovered products. For example, the gas must be dried to prevent ice formation during cryogenic operations. Hydrogen sulfide ordinarily must be removed because of its toxic nature. A large number of commercial processes are in use for treating and separating of raw wellhead gas. The steps used in these different processes are each well known to those skilled in the art.

Natural gas contains mercury at levels at high as 200 to 300 micrograms per cubic meter. For example, the mercury level of natural gas produced from one field is reported in the literature to range from 200 to 330 micrograms per cubic meter. In another field the concentration was reported to range between 15 and 450 micrograms per cubic meter. The processing of natural gas in LNG plants requires at some location in the system contact with equipment made primarily of aluminum. This is particularly true in the stages of processing where the gas has been treated by caustic or carbonate washing to remove $CO_2$ and $H_2S$ and then to treatment with liquid amine to complete $H_2S$ removal. One of the next steps is to chill or cool the gas in aluminum-constructed heat exchangers. Because large volumes of gas must be flowed through the aluminum heat exchangers they are of a massive size and can represent a capitol investment of several million dollars. Damage to these exchangers is to be avoided, if at all possible. One threat of damage comes from the mercury present in the gas flowing through the heat exchangers. Although the concentration of mercury appears low, its effect is cumulative as it reacts by amalgamation with the aluminum. The result is damage to the system, such as corrosion cracking, which can lead to equipment failure, fires, and similar catastrophe. Repair is correspondingly difficult because of damage to the weld of the aluminum. Replacement of the heat exchangers represents a large expenditure. The down-time results in loss of product production. The problem of mercury in natural gas is discussed further in U.S. Pat. No. 4,094,777 and French Pat. No. 2,310,795, both of which are incorporated herein by reference.

Accordingly, one object of this invention is to remove the mercury present in natural gas to a concentration sufficiently low to alleviate mercury damage to equipment, such as the aluminum heat exchangers, in a liquefied natural gas plant. Another object is to minimize the release of mercury vapors into the environment. Still another object is to provide a process for mercury removal which can be integrated into current gas and liquid purification systems at existing LNG plants. Still another object is to provide an improved reactive absorbent material for removing mercury to the desired low levels necessary in the current process schemes.

BRIEF DESCRIPTION OF THE FIGURES

FIG. 3 is a graph showing the relationship between liquid hourly space velocity and the removal of mercury from hexane when the latter is passed over a bismuth-alumina composition.

SUMMARY OF THE INVENTION

Figure 1:
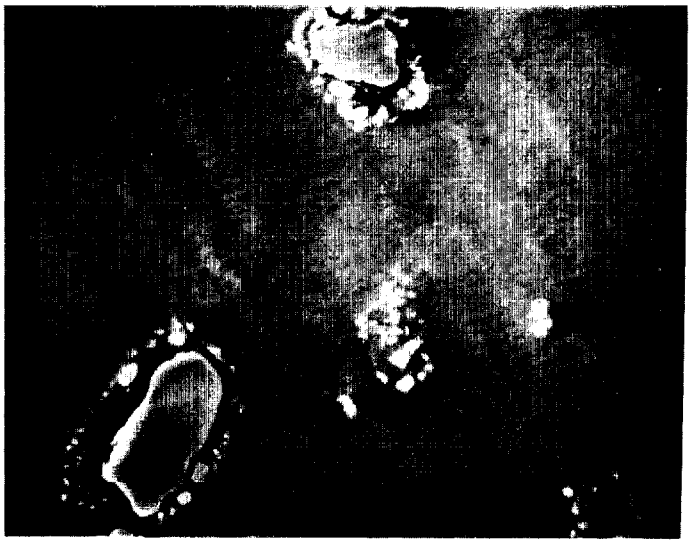
FIG. 1 presents microphotographs showing the surface of the absorbent composition of this invention.

In a broad sense this invention comprises a process for treating raw natural gas prior to liquefaction which comprises (a) passing a stream of raw natural hydrocarbon gas or liquid through a zone containing activated carbon impregnated with sulfur, at conditions effective to remove mercury from said natural gas; (b) passing the effluent stream of natural gas thus treated through a sweetening zone operating at conditions effective to remove carbon dioxide and hydrogen sulfide therefrom and to thereby effect the formation of a stream of sweetened natural gas, and/or passing the effluent stream therefrom through an amine treating system wherein additional hydrogen sulfide is removed, (c) subsequently passing the effluent through a dehydrator where water vapor is removed and (d) finally passing the effluent through a heat exchanger to a further product treatment zone. In this invention there is positioned in the flow line, preferably downstream of the dehydrator, a body of absorbent material made according to the process to be described below. This technique is particularly useful in removing the mercury still remaining in the gas stream even after it has been treated upstream under optimum operating conditions by equipment located upstream. The technique is also effective in removing mercury from liquid hydrocarbon streams recycled through a LNG refrigeration system.

DETAILED DESCRIPTION OF THE INVENTION

In the prior art the most frequently used absorbent used to remove mercury is sulfur loaded on activated carbon. The reaction between the sulfur and mercury is:

$$2\,Hg + S_2 \rightleftharpoons 2\,Hg\,S$$

It is important to recognize that this reaction is a reversible one. This reaction can be carried out efficiently but the extent of mercury removal is limited by the thermodynamic equilibrium. For instance, at 170° F., thermodynamic equilibrium dictates that the residual Hg in the gas stream cannot be lower than 0.03 ppb. Commercial experience has shown this level of mercury in the natural gas to be too high for critical equipment in LNG plants to tolerate when large volumes of gas are processed. Thus, the further removal of residual mercury is necessary. Because thermodynamic properties limit the amount of mercury removed, the removal unit cannot be made more efficient by mechanical improvement. Although lowering the reaction temperature will improve the thermodynamic limitation, the reaction rate is lowered and the life of the absorbent is shortened correspondingly. The optimum operating temperature has been determined to be about 170° F.

This invention in part comprises a reactive absorbent which can remove mercury in both gaseous and liquid streams to low levels.

The reactive absorbents used in this invention are prepared in the following way.

Metal oxides, preferably bismuth and tin, are mixed in powder form with a colloidal silica, aluminum hydroxide, alumina, silica-alumina, clays, and mixtures thereof and ball-milled to assure uniformity. The preferred metal oxides are bismuth and tin. A proper amount of water is added and kneaded into the mixture. The proper amount of water is 40 to 60% of the mixture. The mixture is then extruded or pelleted. When silica is used, the pH of the water added during kneading can be adjusted to a pH of 8 to 11 by adding caustic. The increased pH improves the strength of the extrudate. The pellet extrudate is calcined in air at a rate of temperature increase of 1° C. per minute until a temperature between 300°-500° C. (preferably, 350°-450° C.) is attained. That temperature is maintained for approximately three hours. After the extrudate has cooled to 100° C., air flow is replaced with the flow of hydrogen to reduce the metal oxides to the elemental metal. The product is heated at a rate of 1° C. per minute to the desired reducing temperature, which depends on the nature of the metal oxide. That temperature is maintained for 2 to 10 hours. The reduction temperatures preferred are 200°-400° C. (preferably 250°-350° C.) for bismuth oxide and 250°-500° C. (preferably 350°-450° C.) for tin oxide.

In order to obtain an absorbent of high reactivity it should be reduced at the lowest possible temperature. Precious metals such as platinum and palladium and base metals such as nickel, copper, and cobalt can be added to accelerate the hydrogen reduction reaction and thus to make it possible to lower the reduction temperature. These metals for promoting the reduction of metal oxides can be added by impregnation after the absorbent has been calcined. The metal content required ranges from 0.001 to 0.5 weight percent for precious metals and from 0.1 to 5 percent for the base metals.

The particle size of the metal oxide powders should be as small as possible. It should be less than 250 mesh, preferably less than 325 mesh. The extrudate size depends on the pressure drop that can be tolerated in the reaction bed. Thus the extrudate size can be 1 inch to 1/32 inch, preferably 1/16 inch to ½ inch. To minimize the pressure drop the form of absorbent preferred is a monolithic honeycomb configuration.

Laboratory studies show that when the metal oxide is reduced to the elemental metal, it shrinks, thus creating a hole or crater around the metal particles. The shrinkage leads to increased porosity and pore volume. The absorbent is thus able to accommodate more mercury during the absorption process.

The metal content of the absorbent should be as high as possible without sacrificing the strength of the absorbent. A metal content of 20 to 85% is desirable but a content of 40 to 70% is preferred.

In order to improve the dispersion of metal such as Bi, the $Bi_2O_3$ is first dissolved in nitric acid of 10-50%. The solution is mixed and kneaded with silica to the necessary consistency and then extruded. Similarly $SnO_2$ can be dissolved in $HNO_3$ or HCl.

The finished absorbent material is essentially a collection of reactive metal particles embedded in the matrix of silica or alumina. The matrix provides the strength of the absorbent composition, as well as holding the metal in place. The metals, however, can react with the matrix during the milling, extrusion, and heating steps of the method to form inactive aluminates or other oxides. The method of preparing the absorbent described herein minimizes this reaction. The absorbent has a higher absorption capacity and is more reactive. The method uses the least expensive chemical form, metal oxides, and is easy to implement, resulting in a low cost absorbent material.

Activated carbon can also be utilized as a support medium for the bismuth and tin. Suitable binders include water soluble polymers, such as polyacrylic acid and polyvinyl alcohol. The concentration of polymer binder in a mixture of activated carbon and binder is between 0.01 and 2% by weight of the mixture. The sorbent composition is made most easily by first mixing activated carbon with an aqueous solution of the binder in the desired proportions, then adding tin or bismuth oxides, mixing further and then extruding to the desired shape. The dried extrudate is then heated in a reducing atmosphere to convert the absorbent to its final form for mercury removal.

Figure 2:
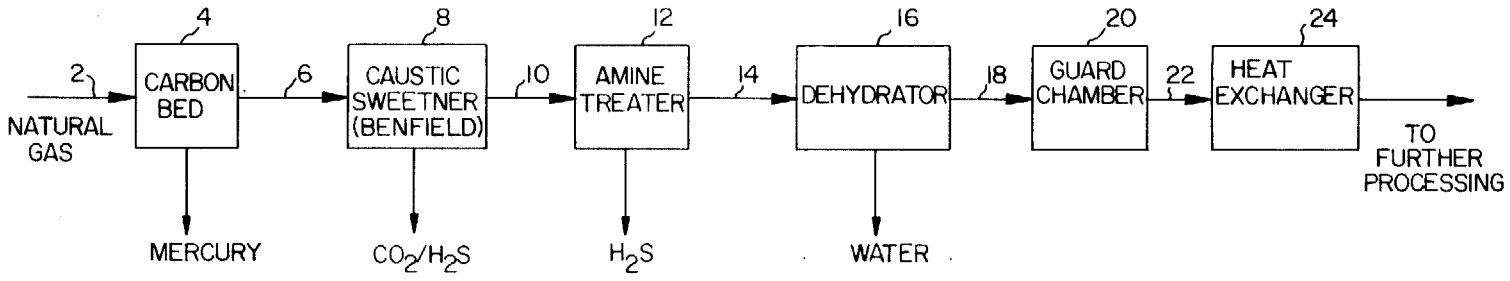
FIG. 2 is a flow sheet showing a preferred embodiment of the invention described herein.

Referring now in the accompanying drawing to FIG. 2, natural gas feed is introduced through line 2 into carbon bed 4 which contains free sulfur deposited on granulated carbon. The bed functions to fix or adsorb a large fraction of the mercury vapor present in the natural gas by interaction with the sulfur. The effluent gas therefrom is then introduced from line 6 into a zone 8 containing preferably a hot aqueous solution of an alkali carbonate, preferably potassium carbonate, at a temperature of about 200° to about 300° F. These hot carbonate processes for sweetening natural gas are known in the art. Most of them contain a proprietary activator, for example the Benfield process, the Catacarb process and the Giammarco-Vetrocoke process. These processes are discussed in U.S. Pat. No. 4,150,962 and 4,070,165, both of which are incorporated herein by reference. The effluent gas from the hot carbonate process is carried through conduit 10 to an amine treating unit 12 for additional processing and removal of hydrogen sulfide. The effluent from the amine treater 12 is flowed by means of conduit 14 through a dehydrator 16 where water vapor is removed from the gas and subsequently into a guard chamber 20 which is filled with the absorbent composition described above. This guard chamber is filled with the absorbent in a honeycomb or multi-lobe configuration impregnated with the reactive metal bismuth and/or tin. Honeycomb and multi-lobe activated carbon is available commercially.

Referring again to the figure, the effluent gas from the guard chamber 20 is then passed through a heat exchanger 22 and to other additional equipment needed for further processing of the gas.

The heat exchanger 24 ordinarily will be made of aluminum and is the particular component of the process from which this invention is intended to protect from attack by mercury. As noted previously, this particular component, because of its aluminum construction, is particularly vulnerable. It's cost of installation, as well as replacement value in many cases where large volumes of gas are processed, can be a substantial capital expenditure.

Although the emphasis of this disclosure has been on gas processing such as in a LNG plant, this invention has utility where hydrocarbon liquids containing mercury are present. These streams include knock out drum bottoms, scrub tower bottoms, and the like.

EXAMPLE 1

A composition of bismuth on $SiO_2$ absorbent was prepared as described above. The bismuth was completely reduced to free metal as indicated by the change in its color from yellow to jet black. The absorbent was embedded in a plastic mold and sliced. Electron microphotographs were made of the thin slices at a magnification of 5000 as shown in FIG. 1. Because of the shrinkage in volume when the metal oxide is reduced to free metal, holes or craters have been created around the metal resulting in an increased porosity and pore volume. This means improved performance for mercury absorption.

EXAMPLE 2

A mixture of $Bi_2O_3$ and $Al(OH)_3$ in a ratio of 20/80 by weight was ball milled with water and then extruded to 1/16" diameter. The extrudate was calcined in air at a temperature increased 1° C./min to 538° C. and then maintained at that temperature for 3 hours. Through this calcination, $Al(OH)_3$ was converted into a high surface area $Al_2O_3$.

The product was reduced in a stream of hydrogen gas flowing at atmospheric pressure and 343° C. for 6 hours. The product was black indicating that the $Bi_2O_3$ had been reduced to Bi metal.

A feedstock was prepared by saturating hexanes with Hg at room temperature, and then diluting each volume of hexane-mercury mixture with 10 volumes of hexanes. Analysis showed that the mercury content of the saturated solution to be 1600 micrograms/liter which was in reasonable agreement with the literature value of 1280 μg/l.

Four cc of the $Bi/Al_2O_3$ composition was packed into a stainless steel tube reactor of ¼" OD×12" long. The feed was fed downflow with a positive displacement pump at the desired rate. The reactor temperature was controlled with a heater. The effluent product was collected in a receiver cooled with ice. After sufficient line-out time, the product was analyzed for Hg using a Jerome mercury vapor analyzer, Model 411. This simple analytical procedure appears to be valid for this study as evidenced by the agreement between the Hg solubilities in hexane determined using this technique and the published value.

Results of the test are shown in Table 1.

TABLE 1

| | | Removal of Hg from Liquid Hydrocarbon Absorbent: $Bi/Al_2O_3$ Hydrocarbon: Hexanes | | | | | | |
|---|---|---|---|---|---|---|---|---|
| | | | Hg, μg/l | | | | Hg Removal | Hg Remains |
| Sample No. | T. °F. | LHSV | I | II | III | Avg | (%) | (%) |
| Feed | — | — | 140 | 150 | 190 | 160 | — | 100 |
| | 77 | 2 | 13.5 | 13.8 | — | 13.7 | 91.5 | 8.5 |
| 62486- 1 | — | — | — | — | — | — | — | — |
| - 2 | — | — | — | — | — | — | — | — |
| - 3 | 100 | 4 | 1.0 | 1.0 | — | 1.0 | 99.4 | 0.6 |
| - 4 | 100 | 4 | 1.1 | 1.0 | — | 1.1 | 99.3 | 0.7 |
| - 5 | 100 | 8 | 1.6 | 1.1 | 1.1 | 1.3 | 99.2 | 0.7 |
| - 6 | 100 | 8 | 2.4 | 2.8 | 1.9 | 2.4 | 98.5 | 1.5 |
| - 7 | 150 | 8 | 3.1 | 2.9 | — | 3.0 | 98.1 | 1.9 |
| - 8 | 150 | 8 | 2.9 | 3.3 | — | 3.1 | 98.1 | 1.9 |
| - 9 | 200 | 8 | 6.3 | 5.6 | 5.6 | 5.8 | 96.4 | 3.6 |
| -10 | 100 | 16 | 2.8 | 2.8 | — | 2.8 | 98.3 | 1.7 |
| -11 | 100 | 16 | 3.8 | 3.7 | — | 3.8 | 97.6 | 2.4 |

The results showed that $Bi/Al_2O_3$ absorbent is effective in removing Hg from liquid hydrocarbon to low levels: At 100° F., and 4 LHSV, the Hg content in hexane was reduced from 160 to 1 μg/l, which was 99.4% removal (FIG. 3). $Bi/Al_2O_3$ is reactive for Hg removal. At 100° F., the LHSV can be as high as 8, $Hr^{-1}$ (FIG. 3). The $Bi/Al_2O_3$ remained effective after passing through 75 volume of feed per volume of absorbent in our short term test. The ultimate life of the absorbent might be about 0.1 lb of mercury of absorbent if the atomic ratio of mercury to bismuth in the exhausted absorbent was ½. The corresponding treating capacity for a feed with 100 μg/l will be $5\times10^5$ volume per volume and the absorbent will last over 50 years.

I claim:

1. In a process wherein a hydrocarbon gas or liquid containing an undesired level of mercury is passed through a flow system and is contacted with aluminum metal processing equipment resulting in damage to said aluminum equipment, the improvement comprising inserting into the flow system upstream of said aluminum equipment a reaction zone containing an absorbent made by:

(a) milling an oxide of a metal selected from the group consisting of bismuth and tin with an oxide selected from the group consisting of silica, aluminum hydroxide, alumina, and mixtures thereof;

(b) mixing the resulting mixture from (a) with sufficient water to form an extrudable composition;

(c) extruding said composition into pellets of predetermined size;

(d) heating said pellets to a temperature of about 300° C. to about 500° C. in an oxidizing atmosphere; and (e) heating said pellets to a temperature of about 200° C. to about 500° C. in a reducing atmosphere.

2. The process of claim 1 wherien said metal is bismuth.

3. The process of claim 1 wherein said metal is tin.

4. A process for the treatment of raw natural hydrocarbon gas containing mercury prior to liquefaction which comprises:

(a) passing said stream of raw natural gas through an aqueous sweetening solution under conditions effective to remove carbon dioxide and hydrogen sulfide, thereby forming a stream of sweetened natural gas containing mercury;

(b) passing the resulting stream of sweetened natural gas through a first drying zone operated at conditions effective to remove water therefrom and to effect the formation of a stream of dried natural gas;

(c) passing the resulting stream of dried sweetened natural gas through a reactor bed containing the absorbent of claim 1; and (d) recovering the resultant stream having a substantially decreased mercury content.

5. The process of claim 4 wherein step (a) includes contacting said natural gas stream with free sulfur deposited on a support.

6. The process of claim 4 wherein the sweetening zone comprises an aqueous alkaline solution.

7. The process of claim 4 wherein the sweetening zone is an amine treater.

8. The process of claim 4 wherein the metal oxide is an oxide of bismuth.

9. The process of claim 4 wherein the metal oxide is an oxide of tin.

10. As a method for preparing a composition for absorbing mercury from a hydrocarbon stream comprising:

(a) milling an oxide of a metal selected from the group consisting of bismuth and tin with an oxide selected from the group consisting of silica, aluminum hydroxide, alumina and mixtures thereof;

(b) mixing the resulting mixture from 9a) with sufficient water to form an extrudable composition;

(c) extruding said composition into pellets of predetermined size;

(d) heating said pellets to a temperature of about 300° C. to about 500° C. in an oxidizing atmosphere; and (e) heating said pellets to a temperature of about 200° C. to about 500° C. in a reducing atmosphere.

11. The method of claim 1 wherein the particle size of the oxide of tin or bismuth is less than about 250 mesh.

12. The method of claim 1 wherein the pH of the water of (b) is adjusted to between about 8 and about 11.

13. A method for preparing a composition for absorbing mercury from a hydrocarbon stream comprising:

(a) dissolving a metal selected from the group consisting of bismuth and tin in a mineral acid;

(b) mixing an aqueous solution of the resulting dissolved metal with a support;

(c) extruding the resulting mixture into pellets of predetermined size;

(d) heating said pellets to a temperature of about 300° C. to about 500° C. in an oxidizing atmosphere; and (e) heating said pellets to a temperature of about 200° C. to about 500° C. in a reducing atmosphere.

14. The method of claim 13 wherein the mineral acid is selected from the group consisting of nitric, hydrochloric and sulfuric acid.

15. The method of claim 13 wherein the support is selected from the group consisting of clay, activated carbon, aluminum hydroxide, alumina, silica-alumina, and mixtures thereof.

16. In a process wherein a hydrocarbon gas or liquid containing an undesired level of mercury is passed through a flow system and is contacted with aluminum metal processing equipment resulting in damage to said aluminum equipment, the improvement comprising inserting into the flow system upstream of said aluminum equipment a reaction zone containing the absorbent of claim 13.

17. The process of claim 16 wherein said metal is bismuth.

18. The process of claim 16 wherein said metal is tin.

19. A process for the treatment of raw natural hydrocarbon gas containing mercury prior to liquefaction which comprises:

(a) passing said stream of raw natural gas through an aqueous sweetening solution under conditions effective to remove carbon dioxide and hydrogen sulfide, thereby forming a stream of sweetened natural gas containing mercury;

(b) passing the resulting stream of sweetened natural gas through a first drying zone operated at conditions effective to remove water therefrom and to effect the formation of a stream of dried natural gas;

(c) passing the resulting stream of dried sweetened natural gas through a reactor bed containing the absorbent of claim 15; and (d) recovering the resultant stream having a substantially decreased mercury content.

20. The process of claim 19 wherein step (a) includes contacting said natural gas stream with free sulfur deposited on a support.

21. The process of claim 19 wherein the sweetening zone comprises an aqueous alkaline solution.

22. The process of claim 20 wherein the sweetening zone is an amine treater.

23. The process of claim 19 wherein the bismuth or tin is mixed with activated carbon and a binder selected from the group consisting of polyacrylic acid and polyvinyl alcohol.

24. The process of claim 1 wherein in step (a) along with the bismuth or tin there is also incorporated a hydrogenation metal in an amount sufficient to accelerate reduction of the bismuth or tin oxide.

25. The process of claim 24 wherein the hydrogenation metal is selected from the group consisting of platinum, palladium, nickel, copper cobalt and mixtures thereof.

* * * * *

UNITED STATES PATENT AND TRADEMARK OFFICE

CERTIFICATE OF CORRECTION

PATENT NO. : 4,709,118

DATED : November 24, 1987

INVENTOR(S) : Tsoung Y. Yan

It is certified that error appears in the above-identified patent and that said Letters Patent is hereby corrected as shown below:

Column 7 line 32 "from 9a" should be --from (a)--

Figure 3 should appear as shown on the attached sheet.

Signed and Sealed this

Twenty-first Day of June, 1988

*Attest:*

*Attesting Officer*

DONALD J. QUIGG

*Commissioner of Patents and Trademarks*

Patent No. 4,709,118
November 24, 1987
Tsoung Y. Yan
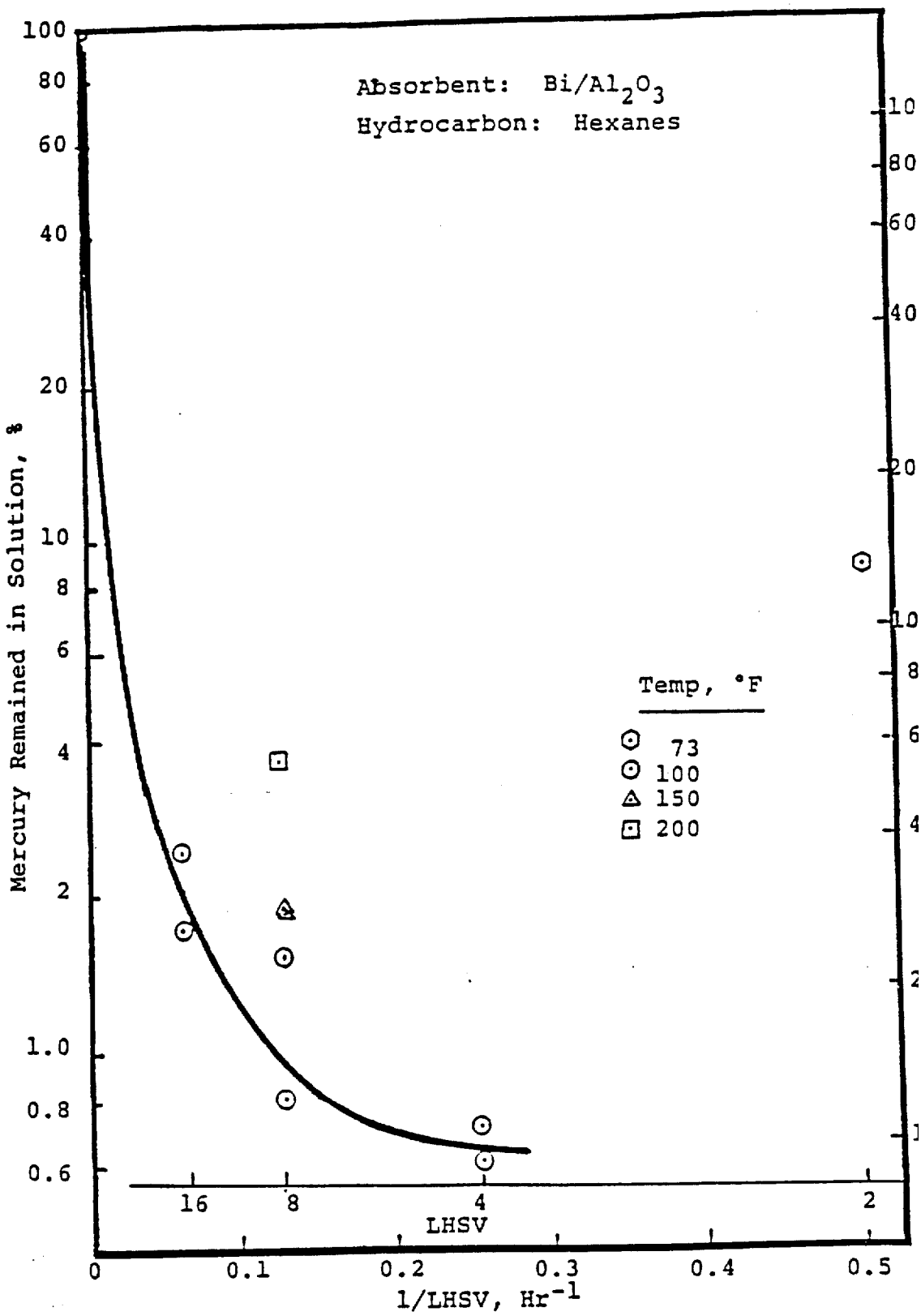
FIG. 3 Mercury Remained vs 1/LHSV